US012233999B1

(12) United States Patent
Slavchev

(10) Patent No.: US 12,233,999 B1
(45) Date of Patent: Feb. 25, 2025

(54) UNIDIRECTIONAL PROPULSION SYSTEM

(71) Applicant: Slavcho Slavchev, Pembroke Pines, FL (US)

(72) Inventor: Slavcho Slavchev, Pembroke Pines, FL (US)

( * ) Notice: Subject to any disclaimer, the term of this patent is extended or adjusted under 35 U.S.C. 154(b) by 0 days.

(21) Appl. No.: 18/912,823

(22) Filed: Oct. 11, 2024

(51) Int. Cl.
*B63H 20/12* (2006.01)
*B63H 20/32* (2006.01)

(52) U.S. Cl.
CPC ..... *B63H 20/12* (2013.01); *B63H 20/32* (2013.01)

(58) Field of Classification Search
CPC ..... B63H 20/12; B63H 20/32
USPC ..... 114/346; 440/54
See application file for complete search history.

(56) References Cited

U.S. PATENT DOCUMENTS 833,218 A * 10/1906 Jennings ..... B63H 20/12 440/58
2,156,938 A * 5/1939 Edwards ..... B63H 5/125 440/75
3,769,930 A * 11/1973 Pinkerton ..... B63H 23/04 440/58
3,968,700 A 7/1976 Cuff
4,261,212 A 4/1981 Melnick
4,479,396 A 10/1984 deWeaver
5,156,058 A 10/1992 Bristow, Jr.
5,388,470 A 2/1995 Marsh, Jr.
5,503,240 A * 4/1996 Hong ..... B62D 5/0433 180/446
5,937,698 A 8/1999 Kunz
8,196,867 B1 6/2012 Wessels
9,631,609 B2 4/2017 Plews
11,149,719 B2 10/2021 Von Bargen
11,260,962 B1 3/2022 Chen
2015/0145364 A1* 5/2015 Holcomb ..... H02K 53/00 74/DIG. 9

* cited by examiner

*Primary Examiner* — Stephen P Avila
(74) *Attorney, Agent, or Firm* — ALBERT BORDAS P.A.

(57) ABSTRACT

An unidirectional propulsion system, having a base assembly with a motor, a rotary mechanism having at least two solenoids and a shaft, and a steering wheel assembly that mounts onto the shaft. The base assembly has a main base, first and second motor poles, and a motor top. The rotary mechanism has a bell housing and a housing base. The rotary mechanism and the base assembly are joined by a swivel. The rotary mechanism further has first and second solenoid tubes supported onto the housing base, a solenoid frame, and an upper frame. The solenoid tubes has respective solenoids, lower springs, upper springs, and bearings. The solenoid frame has first and second solenoid motors.

18 Claims, 10 Drawing Sheets

UNIDIRECTIONAL PROPULSION SYSTEM

BACKGROUND OF THE INVENTION

The present invention relates to propulsion systems, and more particularly, to a unidirectional propulsion system that uses centrifugal force propulsion.

PRIOR ART

Applicant believes that one of the closest references corresponds to U.S. Pat. No. 3,968,700 issued to Cuff Calvin on 1976 Jul. 13 for Device for converting rotary motion into a unidirectional linear motion. However, it differs from the present invention because Calvin teaches a device that converts centrifugal forces produced by rotating masses into a propulsive force acting in one direction and which is comprised of a movable supporting structure in which identical sets of masses rotate in opposite directions about an axis which is perpendicular to the desired direction of travel and a mechanism for continuously varying the radius of gyration of each mass during its cycle of revolution.

Applicant believes that another reference corresponds to U.S. Pat. No. 5,937,698 issued to Kunz; William T. on 1999 Aug. 17 for Centrifugal Propulsion System. However, it differs from the present invention because Kunz teaches a centrifugal force propulsion device that includes an eccentric rotor rotatably mounted to a base via a shaft. The rotor has an aperture therein which is substantially larger than the shaft, such that the rotor is able to rotate at speed away from the shaft, as well as move longitudinally perpendicular to the axis of rotation. A drive motor drives the rotor through a stretchable flexible belt. As centrifugal force rotates the rotor toward a longitudinal standing position alone away from the shaft and drive motor, and as the drive belt is stretched, the increased tension therein pulls the drive motor and base ahead following the rotor, thus pulling the device in a desired direction.

Applicant believes that another reference corresponds to U.S. Pat. No. 8,196,867 issued to Wessels; Mark on 2012 Jun. 12 for Space Elevator Propulsion System Using Mechanical Waves. However, it differs from the present invention because Wessels teaches a system and method for propelling a carriage on a cable of a space elevator. The space elevator system includes a cable anchored to a terrestrial body on a first end and a counterweight on an opposing second end and a carriage riding along the cable. The system also includes an oscillator for generating a mechanical wave upon the cable. Mechanical energy created by the generated mechanical wave is converted into power to propel the carriage upon the cable. The oscillator may include a pair of opposing pistons contacting the cable on opposite sides of the cable or an electromagnetic driver powered by electromagnets located on opposite sides of the cable. As the altitude increases, the strength of the centrifugal force increases relative to gravity. This centrifugal force is directed outwardly away from the Earth. Therefore, the centrifugal force actually assists the carriage as it moves upward.

Applicant believes that another reference corresponds to U.S. Pat. No. 5,388,470 issued to Marsh, Jr.; Richard O. on 1995 Feb. 14 for Centrifugal Force Drive Machine. However, it differs from the present invention because Marsh teaches a centrifugal force drive machine for generating force in a controlled direction. The machine includes a machine frame having a shaft mounted thereto for rotation about its axis. The drive mechanism is provided to rotate the shaft about its axis. At least one mass is mounted on the shaft for rotation therewith. Each mass has a center of gravity which is moveable radially with respect to the shaft between the position in which the mass is rotationally balanced about the shaft and a position in which the mass is unbalanced. A control member in an operative connection between the mass and the frame is provided to constrain radial movement of the mass between the balanced position and the unbalanced position during each revolution thereof. When a mass is in the unbalanced position, the centrifugal force generated by the rotation of the mass is transmitted to the control member, thereby generating a linear force in the controlled direction.

Applicant believes that another reference corresponds to U.S. Pat. No. 5,156,058 A issued to Bristow, Jr.; Theodore R. on 1992 Oct. 20 for Method and Apparatus For Converting Rotary Motion To Lineal Motion. However, it differs from the present invention because Bristow teaches an apparatus and method of orbiting a first mass unit alternately about spaced centers of rotation with the orbit around each of the spaced centers of rotation extending for approximately one-half of a complete circle. Also orbiting a second mass unit side-by-side with the first mass unit but in the opposite direction, and adjusting the spaced centers of rotation relative to each other so that the resultant of first and second unbalanced centrifugal forces produced by the first and second mass units is a substantially straight line. The apparatus provides side-by-side outer wheels spinnable in opposite directions about a common axis, inner wheels positioned within the outer wheels and formed for joint rotary movement therewith about the common axis. The inner wheels being mounted for eccentric rotation with respect to the outer wheels about an offset axis so that spacing between the inner and outer wheels varies as they are rotated jointly about the common axis. A plurality of generally radially extending rods are slidably mounted in the rims of the inner and outer wheels and have the mass unit on the outer end of each such rod. Inner and outer orbit limiting keepers are mounted in spaced relation along each of the rods so that the radius of orbit of the mass units is varied by alternate engagement of the orbit limiting keepers with the rims of the inner and outer wheels.

Applicant believes that another reference corresponds to U.S. Pat. No. 4,261,212 A issued to Melnick; Harry S. on 1981 Apr. 14 for Unidirectional Force Generator. However, it differs from the present invention because Melnick teaches a device for producing a unidirectional force, which may be used to propel a vehicle or other body in one direction or to serve in other applications requiring such a force. The device uses a centrifugal force generator which repetitively provides alternately occurring prolonged centrifugal forces of opposite direction along a line fixed relative to the generator. As these forces are produced the generator is turned relative to a supporting carriage so that each time such a force occurs it has a generally forward direction relative to the carriage. Two or more centrifugal force generators may be mounted on a single carriage and operated in synchronism and in proper phase relationship to one another to produce a forwardly directed force of relatively steady magnitude and/or to cancel force components directed perpendicular to the forward direction.

Applicant believes that another reference corresponds to U.S. Pat. No. 4,479,396 A issued to deWeaver; Fred on 1984 Oct. 30 for Propulsion System. However, it differs from the present invention because deWeaver teaches a propulsion system for converting rotary motion into unidirectional motion and consisting of a frame. A pair of counterrotating lower members are rotatably mounted to the frame and contain damping elements. A pair of upper members contain damping elements and are rotatably mounted to the frame and positioned above the lower members, each at an angle to the lower member so that each contacts a surface of the member below it at a single point, and a motor and drive train for driving the lower members. Each lower member includes a pair of studs mounted at its periphery which engage radially extending posts mounted to its corresponding upper cylinder so that rotation of the lower member causes the upper member to rotate in the same sense and at the same angular velocity. The superposition of the damped upper members upon the damped lower members generates unbalanced centrifugal forces which create a constant unidirectional resultant force.

Applicant believes that another reference corresponds to U.S. Pat. No. 11,260,962 B1 issued to Chen; Franklin Y. on 2022 Mar. 1 for Centrifugal-Force-Propulsion And Control System and Applications. However, it differs from the present invention because Chen teaches a propulsion and maneuver-control system for crafts and devices that develops its desired thrust force vectors from the vectors sum of centrifugal force vectors of rotating masses and their controlled gyroscopic force vectors. Also shown are applications of this propulsion and maneuver-control system for future VTOL-Hovering-Flying crafts, Scooters, Surfboards, marine/submarine-crafts, earth, moon, mars satellites disks and space-crafts.

Applicant believes that another reference corresponds to U.S. Pat. No. 11,149,719 B2 issued to Von Bargen; Edward on 2021 Oct. 19 for EdDrive Propellantless Propulsion System. However, it differs from the present invention because Von Bargen teaches a method and system for electric-powered propellantless propulsion in space. In addition to its methods to produce thrust, the system is also incorporated into propellantless velocity control and propellantless direction control systems. Embodiments of a mechanical propulsion system do not require a propellant and do not violate Newton's Laws of Motion. A significant amount of thrust solely in the intended direction of the propulsion system is produced, with the main elements needed the operation. Propellantless propulsion harvest kinetic energy and simultaneously produce a significant amount of thrust.

Applicant believes that another reference corresponds to U.S. Pat. No. 9,631,609 B2 issued to Plews; Dennis J. on 2017 Apr. 25 for Device for Propulsion System. However, it differs from the present invention because Plews teaches a device that produces linear motion by sequentially and in a continuous sequence accelerating inertial thrust masses at well-defined times towards the axis of counter-rotating disks. The inertial thrust masses are contained in cavities placed equidistantly about the periphery of counter rotating capture disks mounted on a common axle. They are radially accelerated by a bi-directional impulse ramps that can be moved to any position around the periphery of the counter rotating capture plates and into and out of the paths of the gyrating thrust masses to any desired depth within the mechanical range of the impulse ramps which simultaneously engage and radially accelerate the inertial thrust masses of each counter-rotating capture plate. The counter-rotating capture plates are each separately driven by a gear assembly powered by an external engine or motor that powers the rotation of the disks. Each radial acceleration of the inertial thrust masses produces an impulse of force that pushes against the mass accelerator with a force equal to the force used to radially accelerate each thrust mass. Each impulse is a vector force and imparts motion along the chosen vector to any object to which the device is attached.

Other patents describing the closest subject matter provide for a number of more or less complicated features that fail to solve the problem in an efficient and economical way. None of these patents suggest the novel features of the present invention.

SUMMARY OF THE INVENTION

The present invention is an unidirectional propulsion system, comprising a base assembly having a motor, a rotary mechanism comprising at least two solenoids and a shaft, and a steering wheel assembly, which mounts onto the shaft.

The base assembly comprises a main base, first and second motor poles, and a motor top.

The rotary mechanism comprises a bell housing and a housing base. The rotary mechanism and the base assembly are joined by a swivel. The rotary mechanism further comprises first and second solenoid tubes supported onto the housing base, a solenoid frame, and an upper frame.

The first and second solenoid tubes comprises respective solenoids, respective first and second lower springs, respective first and second upper springs, and respective bearings. The solenoid frame comprises first and second solenoid motors.

The rotary mechanism further comprises at least two pulleys, at least two solenoid cables, at least two annulus weights, and at least two annulus shafts. The solenoid cables extend from their respective solenoids to respective annulus weights, running over a respective pulley.

The rotary mechanism further comprises at least two weight shaft springs, at least two weigh bearings, a pulley frame, and on-switches.

The at least two solenoid tubes having respective solenoids extend vertically, defining a predetermined angle with respect to the shaft.

The steering wheel assembly comprises a steering wheel frame, steering motors, a gear wheel, a steering wheel gear, steering motor bearings, and a top cover. The top cover is curved. The steering wheel frame has an upper shaft and is mounted perpendicularly to the shaft. The upper frame has respective annulus weights and annulus shafts that are also perpendicular to the shaft.

The base assembly is stationary. The rotary mechanism rotates onto the shaft with a predetermined speed generating a centrifugal force, whereby at least two annulus weights move outwardly. The generated centrifugal force is converted in an unidirectional driving force. The steering wheel assembly is static while the rotary mechanism rotates. The rotary mechanism rotates in both directions.

It is therefore one of the main objects of the present invention to provide an unidirectional propulsion system.

It is another object of this invention to provide an unidirectional propulsion system that is incorporated into vehicles and crafts designed for airspace, outer space, and liquid/water environments.

It is another object of this invention to provide an unidirectional propulsion system that includes but is not limited to spacecrafts, hovering crafts, flying crafts, marine crafts, and submarine crafts in various planetary atmospheres including liquid environments.

It is another object of this invention to provide an unidirectional propulsion system that uses centrifugal force propulsion.

It is another object of this invention to provide an unidirectional propulsion system, which has a rotary mechanism.

It is another object of this invention to provide an unidirectional propulsion system, which is of a durable and reliable construction.

It is yet another object of this invention to provide such a device that retains its effectiveness.

Further objects of the invention will be brought out in the following part of the specification, wherein detailed description is for the purpose of fully disclosing the invention without placing limitations thereon.

BRIEF DESCRIPTION OF DRAWINGS

With the above and other related objects in view, the invention consists in the details of construction and combination of parts as will be more fully understood from the following description, when read in conjunction with the accompanying drawings in which.

Figure 1:
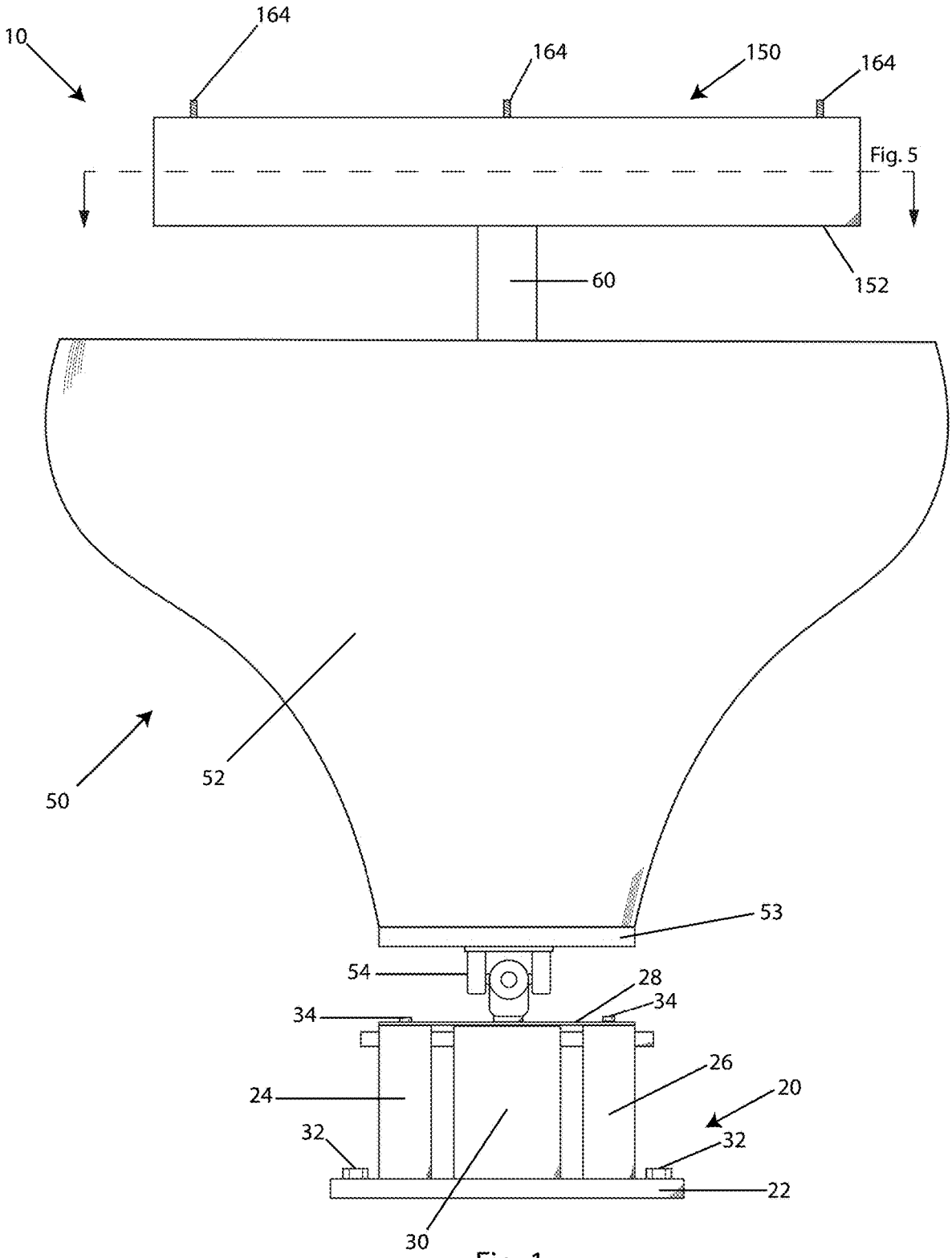
FIG. 1 represents a front view of the present invention.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

DETAILED DESCRIPTION OF THE INVENTION

Referring now to the drawings, the present invention is an unidirectional propulsion system and is generally referred to with numeral 10. It can be observed that it basically includes base assembly 20, rotary mechanism 50, and steering wheel assembly 150.

Figure 2:
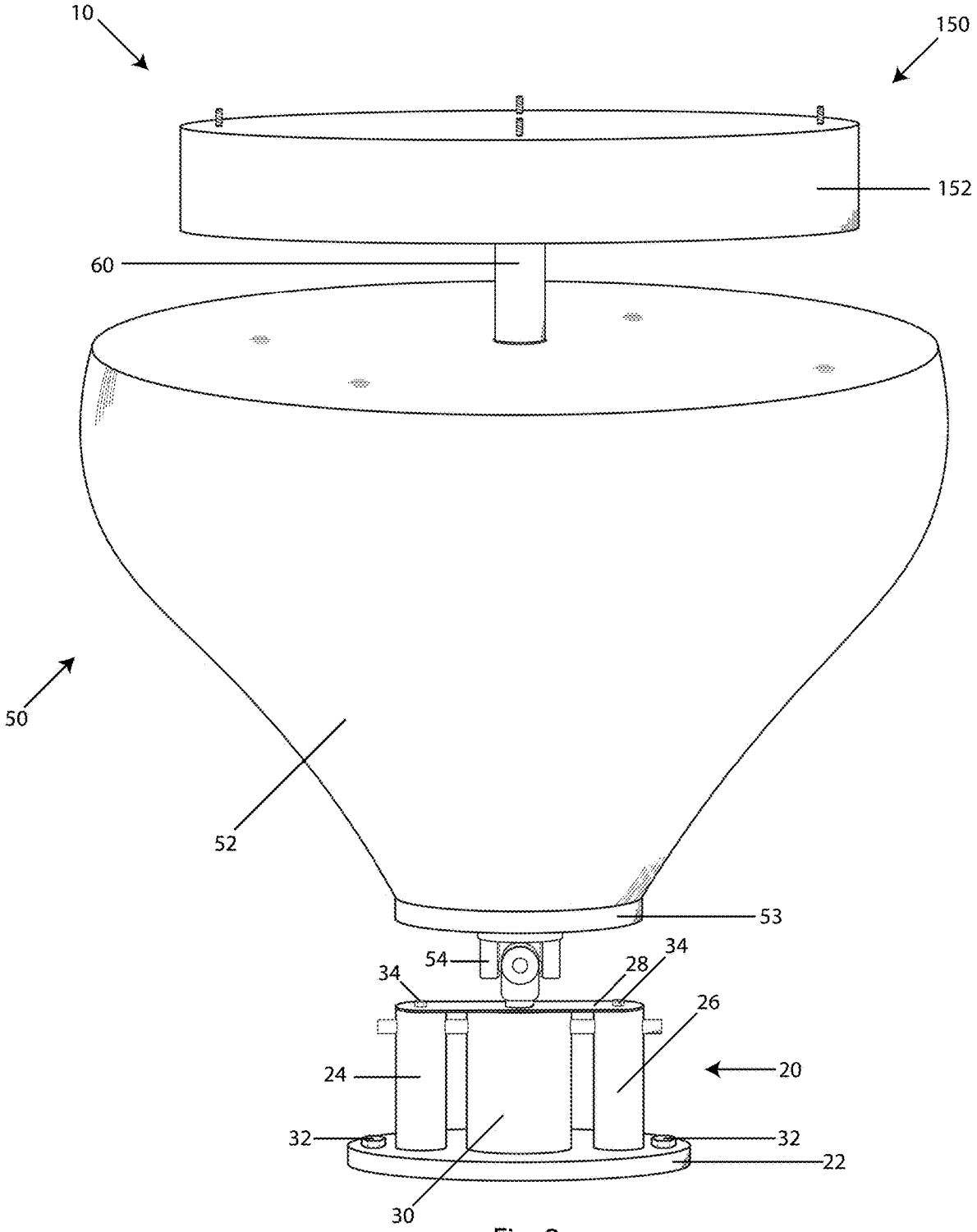
FIG. 2 is an isometric view of the present invention.

As seen in FIGS. 1 and 2, base assembly 20 comprises main base 22, first and second motor poles 24 and 26 respectively, motor top 28, and motor 30. Main base 22 comprises base bolts 32.

In a preferred embodiment, motor 30 is an electric motor. Motor 30 works in steps to increase or decrease propulsive force.

Motor top 28 is fixed to motor poles 24 and 26 by top bolts 34.

Rotary mechanism 50 comprises bell housing 52 and housing base 53.

Figure 3:
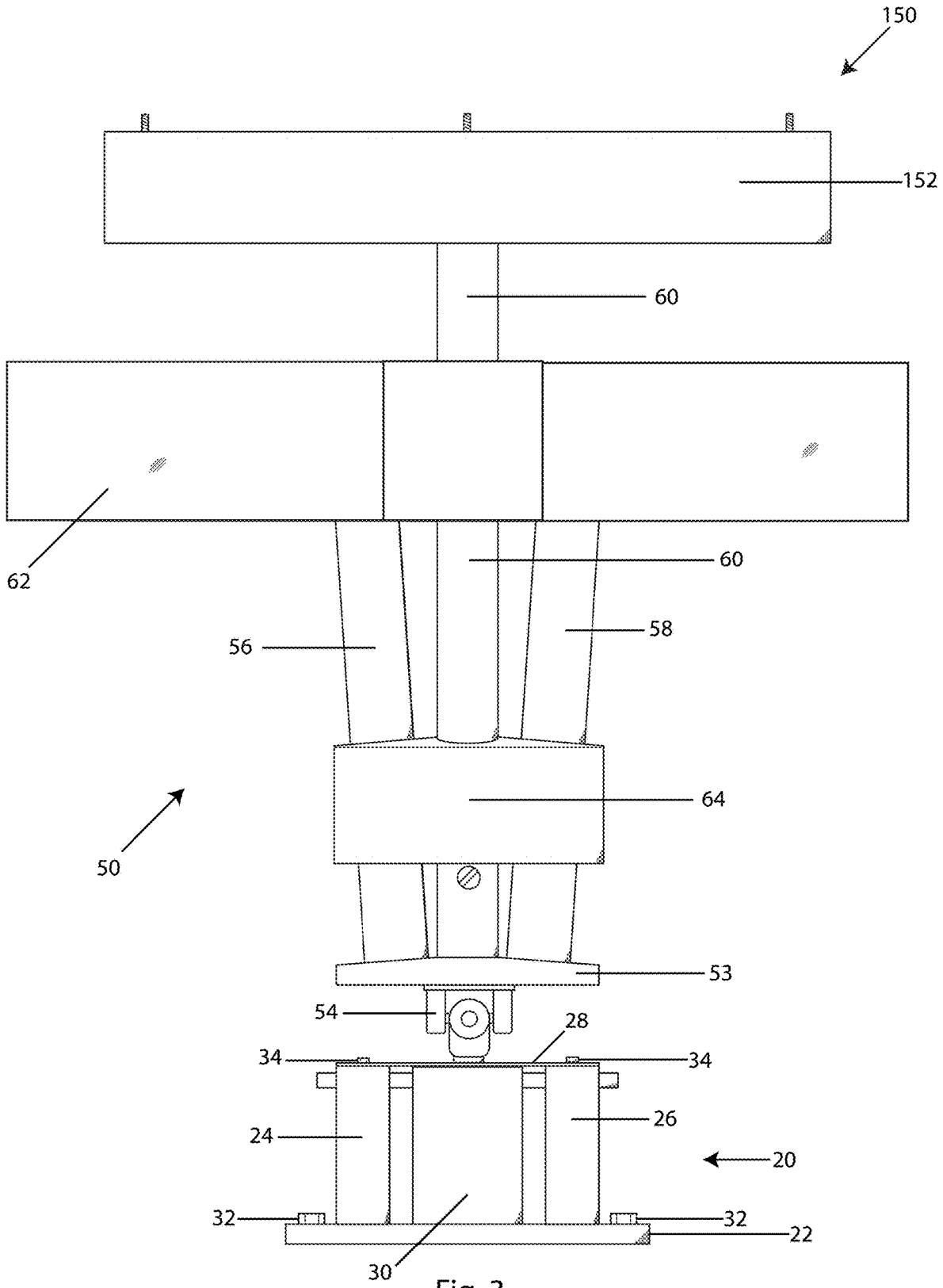
FIG. 3 is a front view of the present invention without a bell housing.
Figure 4:
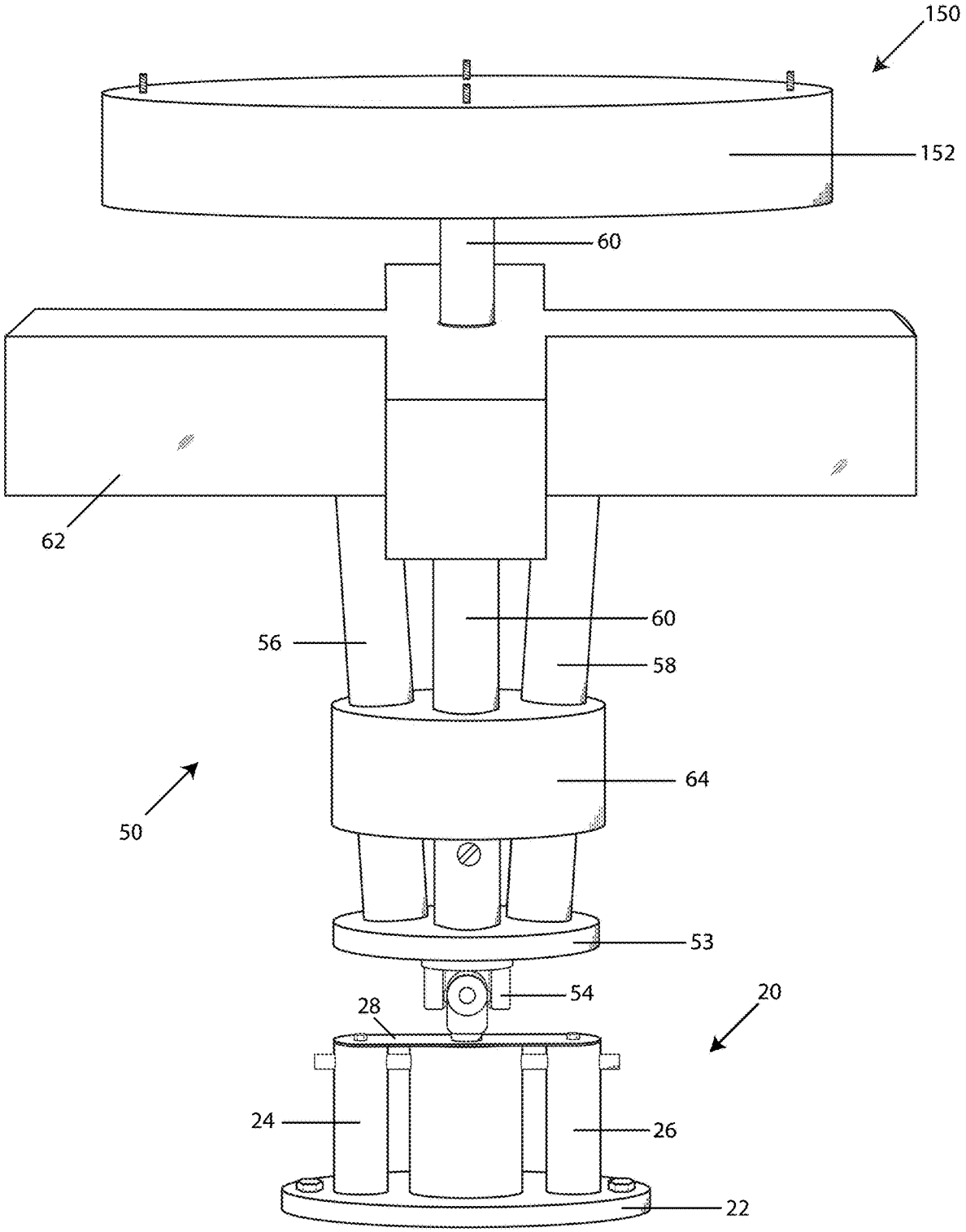
FIG. 4 is an isometric view of the present invention without the bell housing.

As seen in FIGS. 3 and 4, rotary mechanism 50 comprises shaft 60. Shaft 60 extends from swivel 54 to steering wheel assembly 150.

Rotary mechanism 50 and base assembly 20 are joined by swivel 54.

Rotary mechanism 50 further comprises at least two solenoid tubes 56 and 58 secured onto housing base 53, upper frame 62, and solenoid frame 64.

Steering wheel assembly 150 mounts onto shaft 60.

Figure 5:
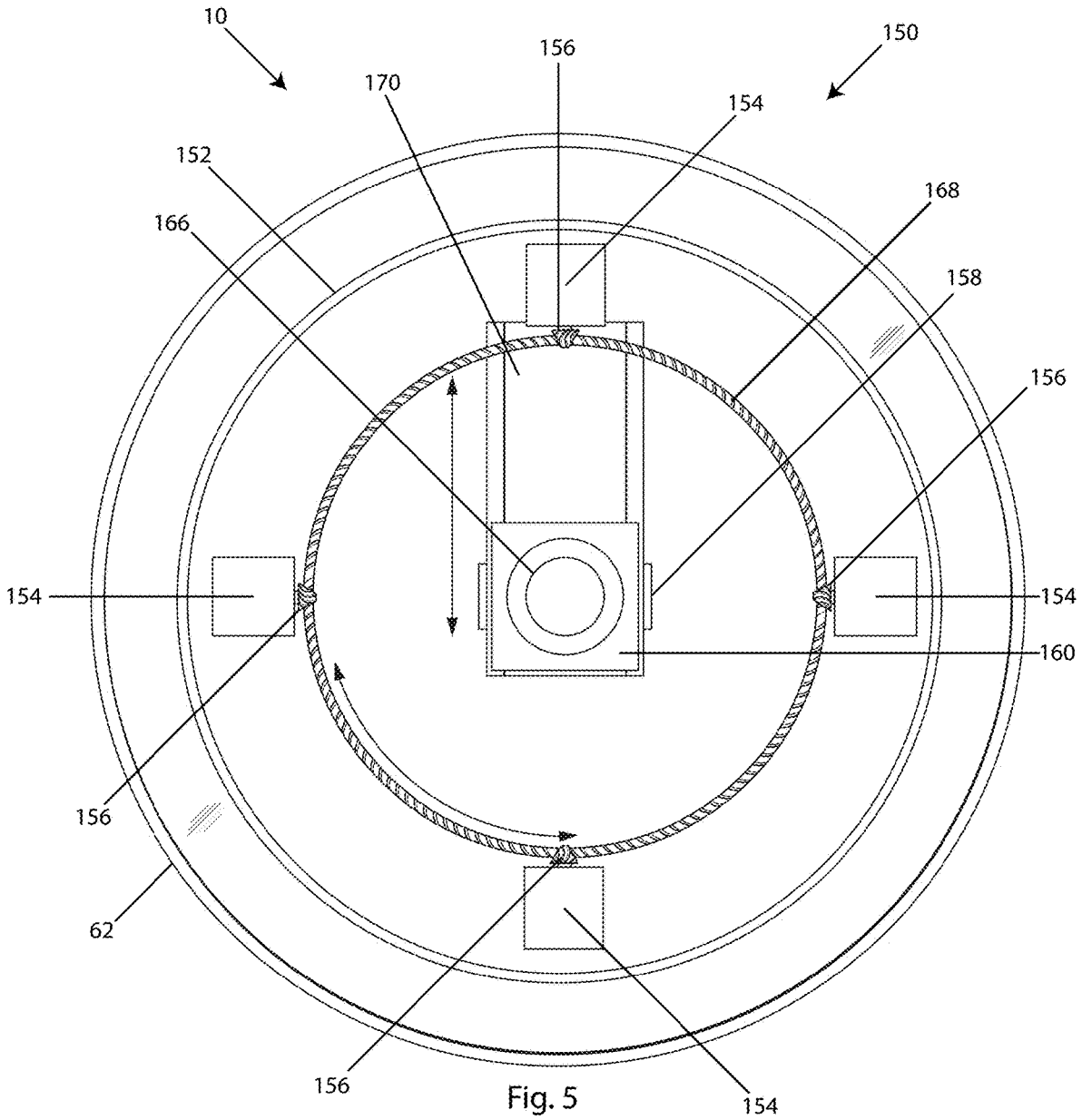
FIG. 5 is a cut view taken along lines 5-5 from FIG. 1.
Figure 6:
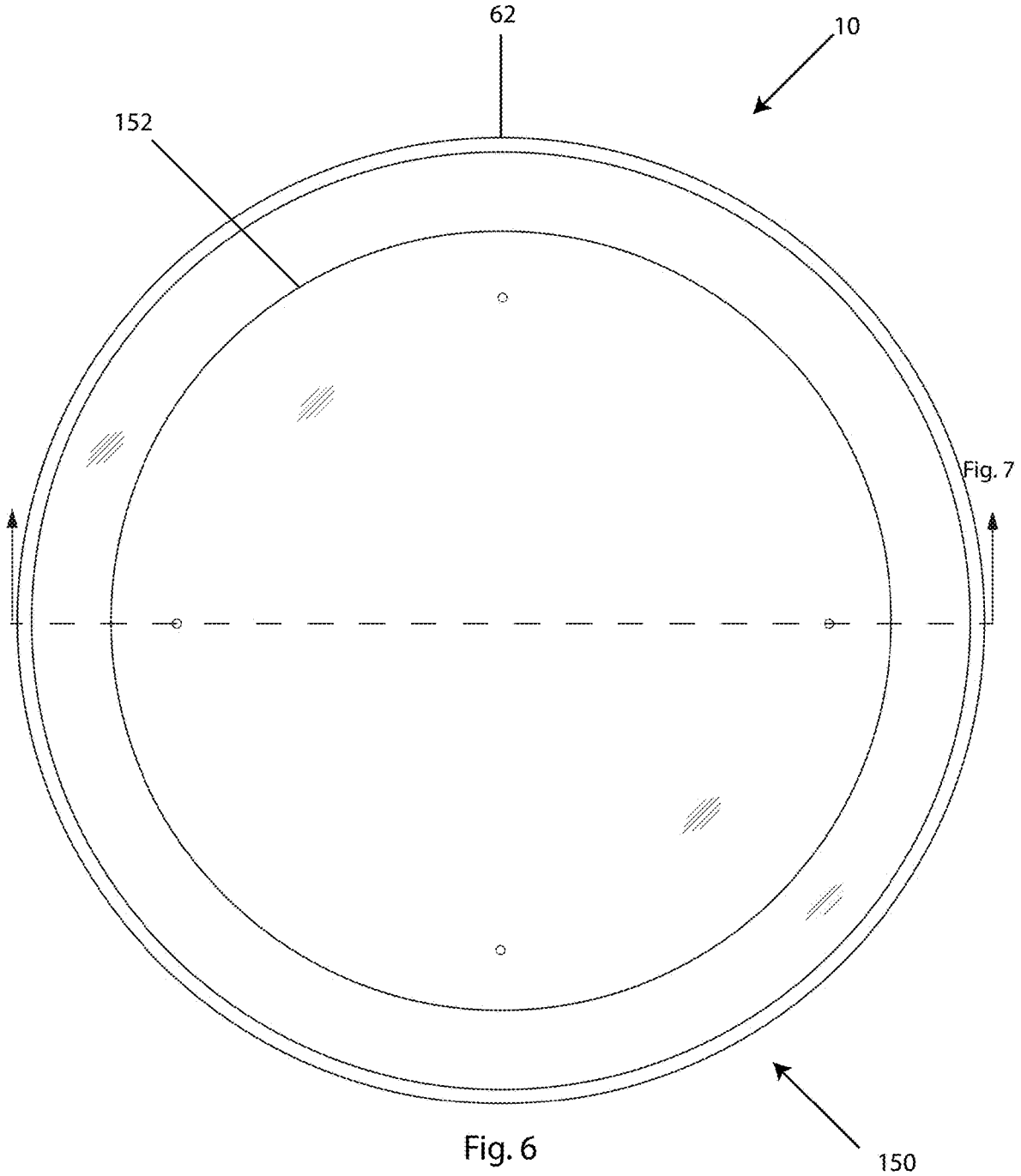
FIG. 6 is a top view of the present invention.
Figure 7:
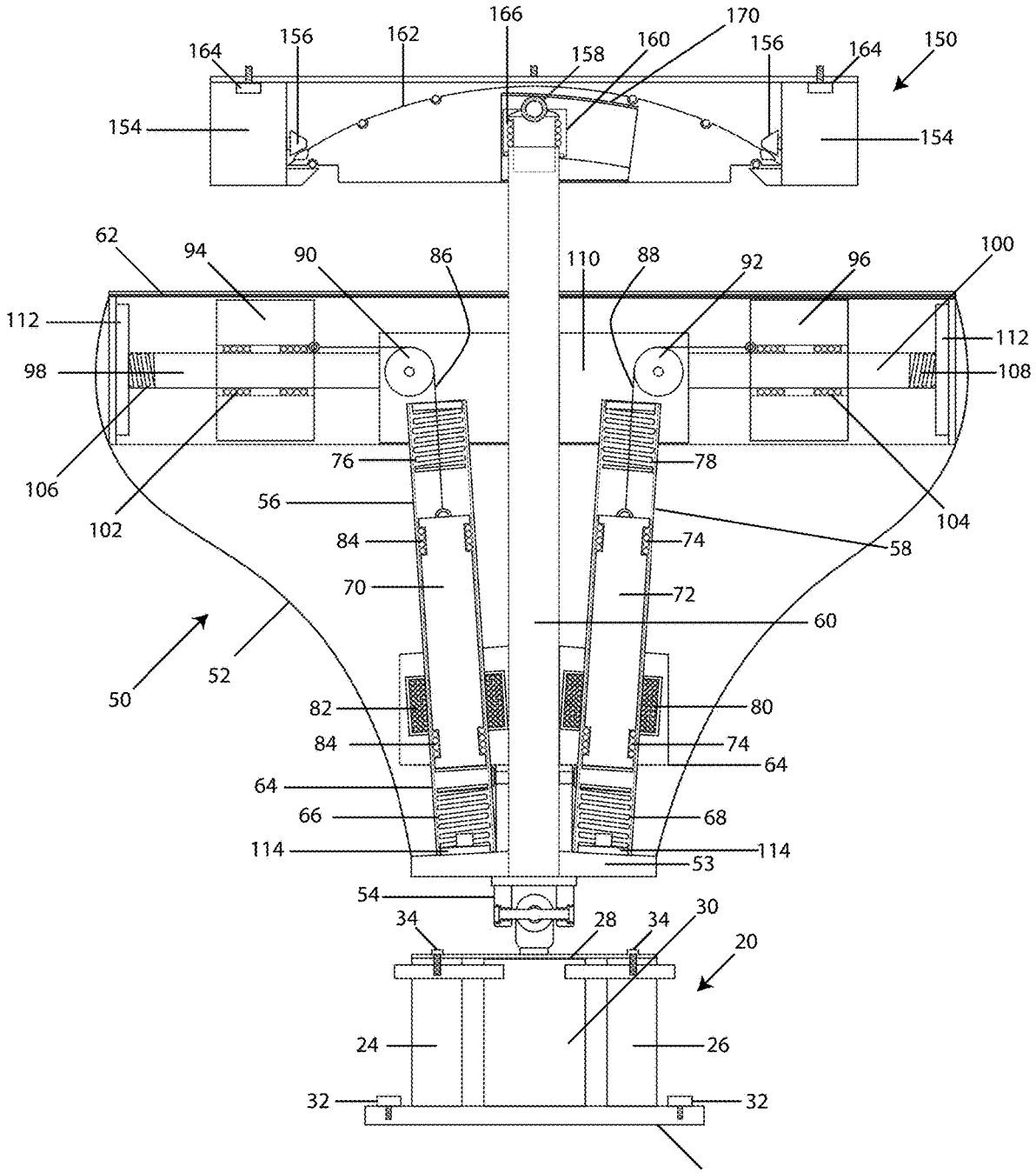
FIG. 7 is a cut view taken along lines 7-7 from FIG. 6.

As seen in FIGS. 5, 6, and 7, steering wheel assembly 150 comprises steering wheel frame 152, steering motors 154, gear wheels 156, steering wheel gear 158, and top cover 162. In a preferred embodiment, top cover 162 is curved.

Steering wheel frame 152 has upper shaft 170 mounted perpendicularly to shaft 60.

Steering wheel assembly 150 further comprises steering wheel ring gear motor 160 having steering motor bearings 166 and ring gear 168. Steering motors 154 are fixed by bolts 164. Bolts 164 also secure steering wheel assembly 150.

There are two steering wheel ring gear motors 160, one on each side, that turns steering wheel gear 158, which is attached onto upper shaft 170. Steering wheel ring gear motor 160 is mounted onto shaft 60. When steering wheel gear 158 moves onto upper shaft 170, it defines a predetermined angle with respect to shaft 60 in all directions. This allows for changes in steering direction of the craft.

Current comes from motor 30 and is generated by induction.

In a preferred embodiment, present invention 10 comprises four steering motors 154 that are connected in parallel.

Figure 8:
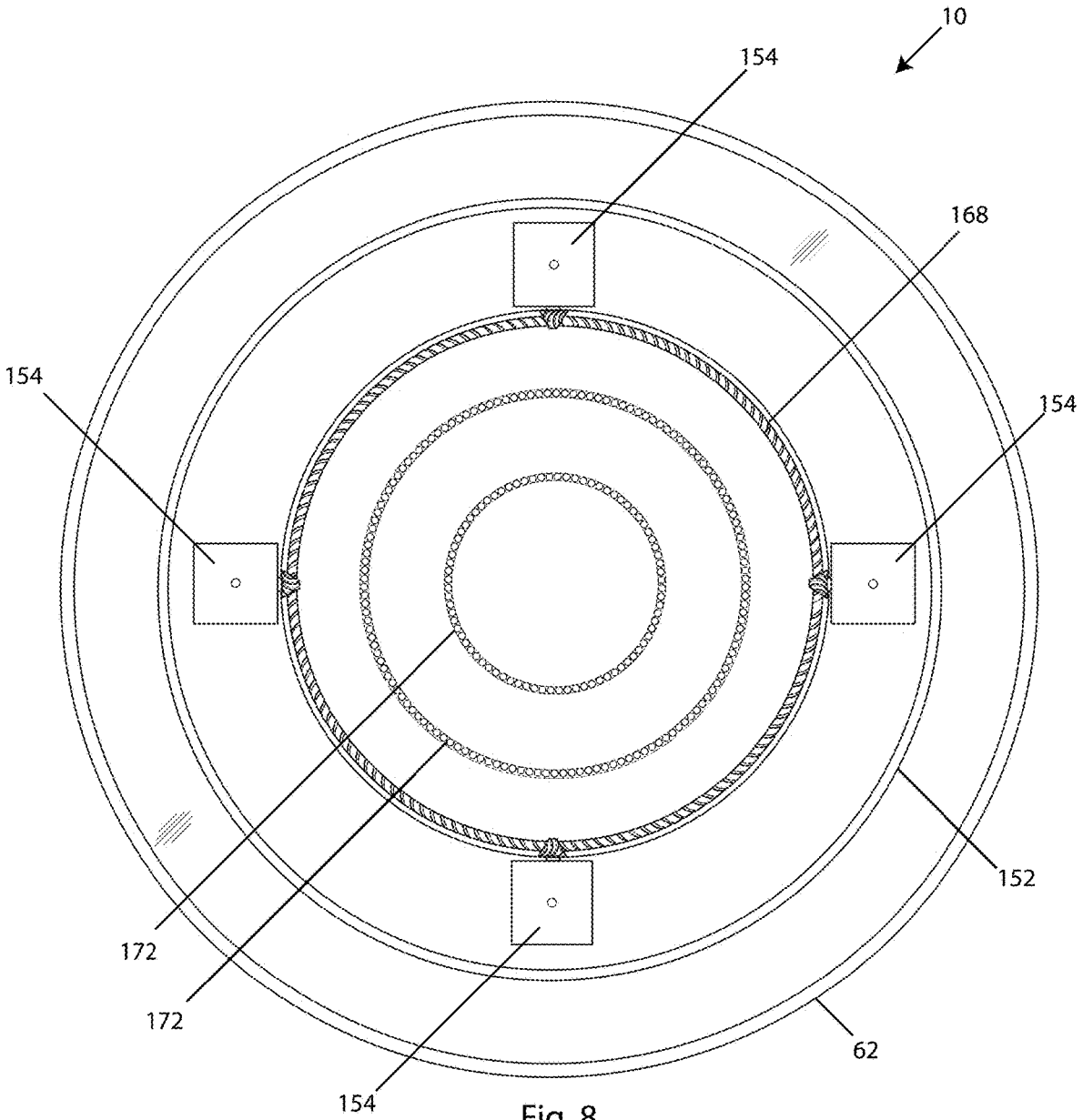
FIG. 8 is a top view of the present invention without its steering wheel frame.

As seen in FIGS. 7 and 8, solenoid tubes 56 and 58 comprise lower springs 66 and 68 respectively, solenoids 70 and 72 respectively, upper springs 76 and 78 respectively, and respective bearings 74 and 84. Solenoid frame 64 holds first and second solenoid motors 80 and 82. Solenoid motors 80 and 82 are connected in series.

Rotary mechanism 50 further comprises at least two solenoid cables 86 and 88, at least two pulleys 90 and 92, at least two annulus weights 94 and 96, and at least two annulus shafts 98 and 100. Solenoid cables 86 and 88 extend from respective solenoids 70 and 72 to respective annulus weights 94 and 96, running over respective pulleys 90 and 92.

Unidirectional force is provided by solenoids 70 and 72. A centrifugal force resets solenoids 70 and 72 in an upper position and actuates on-switch 112. Propulsive forces come from the "on" and "off" switching of solenoids 70 and 72.

The propulsive force is indirect as a result of a reaction force of solenoids 70 and 72 when pushed down by respective solenoid motors 82 and 80. Solenoid motors 80 and 82 are switched simultaneously for a propulsive force to reach its peak.

Solenoids 70 and 72 apply an upward force when on-switch 112 is "on". Solenoid motors 82 and 80 apply a downward force when off-switch 114 turns "off", while centrifugal forces pull annulus weights 94 and 96.

This connection ensures that solenoid motors 80 and 82 remain balanced at each switching cycle. Forces and loads are predetermined and the drive can be controlled to accelerate, decelerate, or stop all together if needed to avoid overloading.

Upper frame 62 comprises inside annulus weights 94 and 96, annulus shafts 98 and 100, and pulleys 90 and 92. Upper frame 62 is perpendicular to shaft 60.

Rotary mechanism 50 further comprises at least two weight shaft springs 106 and 108, at least two weigh bearings 102 and 104, pulley frame 110, and on-switches 112. On-switches 112 are connected in series.

Solenoid tubes 56 and 58 have respective solenoids 70 and 72 that extend vertically to define a predetermined angle with respect to shaft 60.

As best seen in FIG. 8, steering wheel assembly 150 comprises ring bearings 172.

Figure 9:
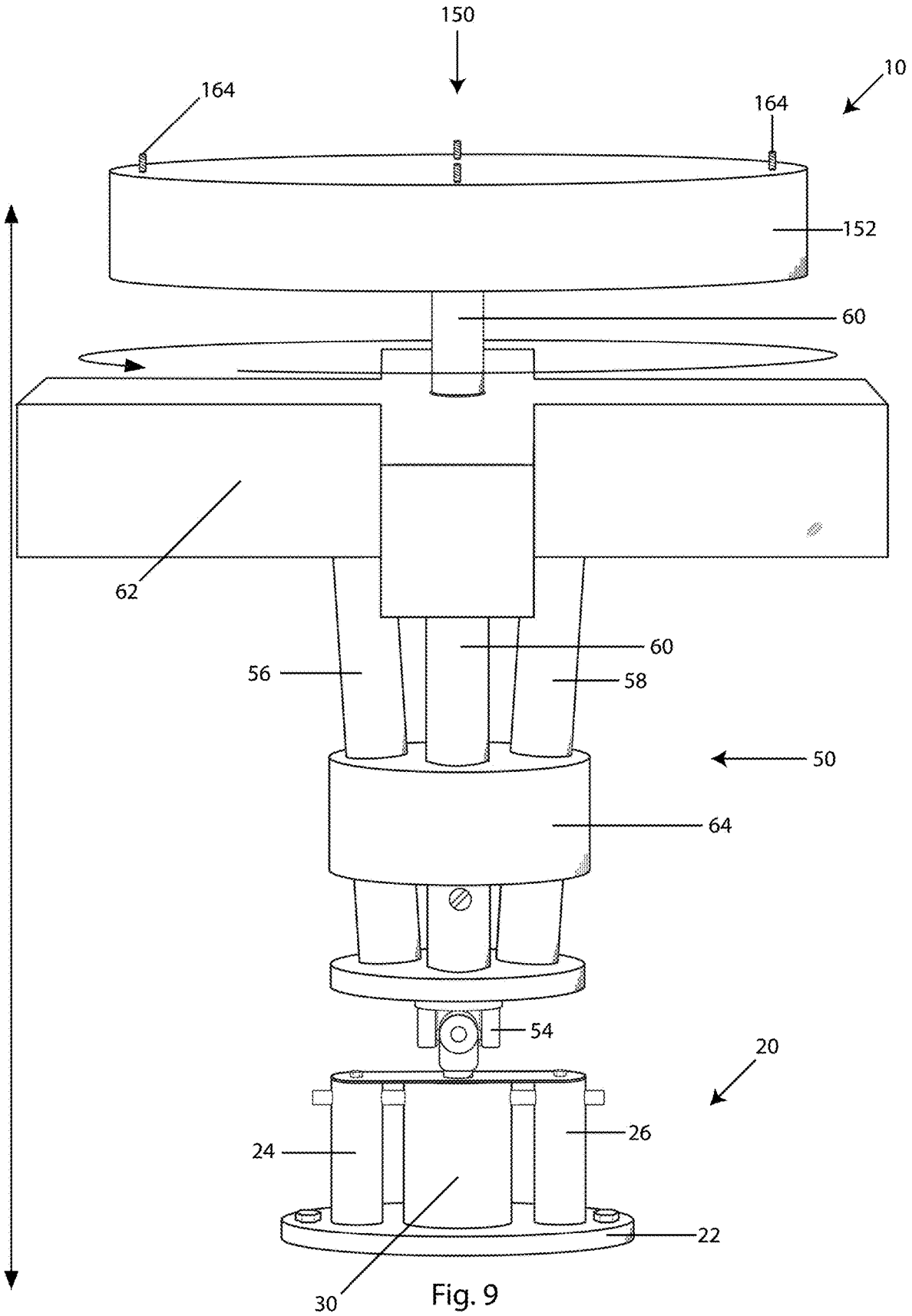
FIG. 9 is an isometric view of the present invention representing a rotation.
Figure 10:
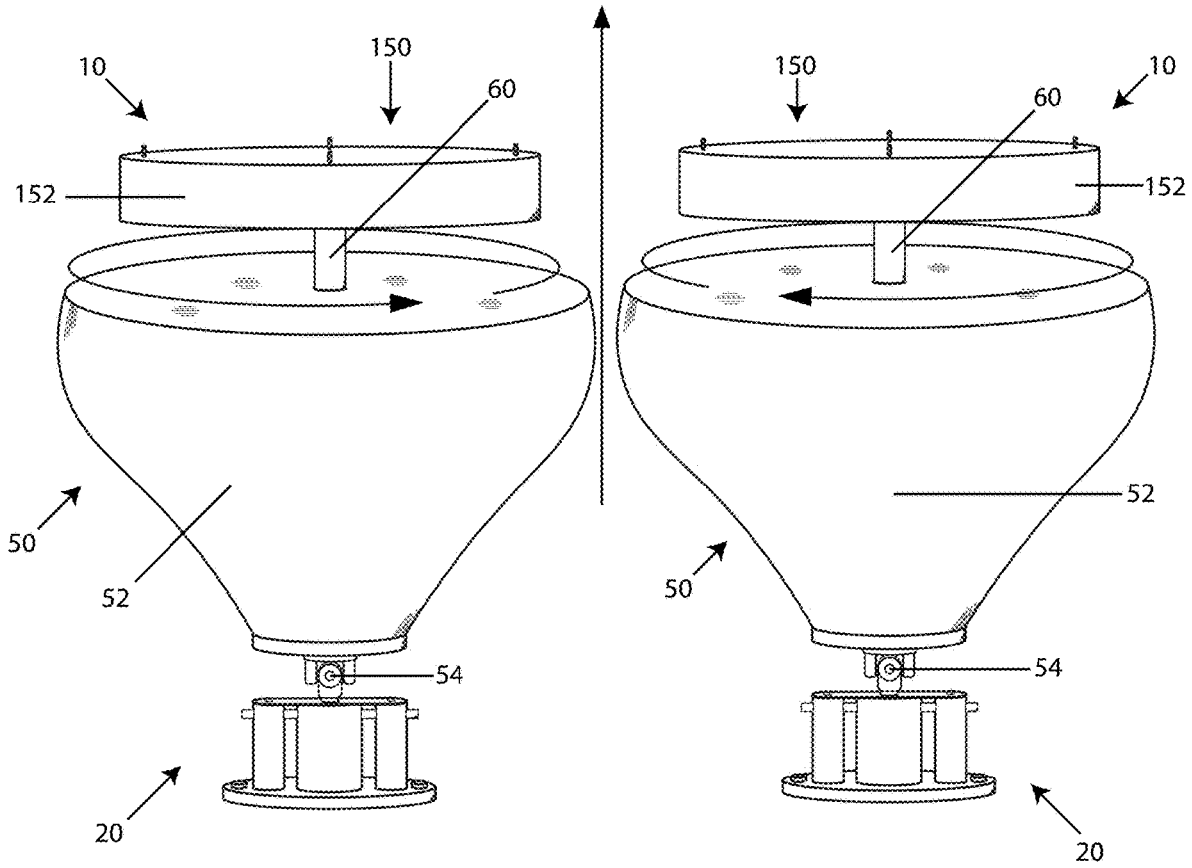
FIG. 10 is an isometric view of the present invention representing rotation in both directions.

As seen in FIGS. 9 and 10, rotary mechanism 50 rotates onto shaft 60 with a predetermined speed, generating a centrifugal force, whereby at least two annulus weights 94 and 96 that are positioned opposite to each other, seen in FIG. 7, move outwardly. Generated centrifugal force is converted as an unidirectional driving force. Rotary mechanism 50 rotates in both directions.

In a preferred embodiment, a first steering wheel assembly 150 moves simultaneously with a second steering wheel assembly 150. Steering wheel assembly 150 is stationary while rotary mechanism 50 rotates around shaft 60. Base assembly 20 is also stationary.

In a preferred embodiment, present invention 10 is incorporated into vehicles and crafts designed for airspace, outer space, and liquid/water environments. Such vehicles and crafts include but are not limited to spacecrafts, hovering crafts, flying crafts, marine crafts, and submarine crafts in various planetary atmospheres including liquid environments.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An unidirectional propulsion system, comprising:

A) a base assembly having a motor;

B) a rotary mechanism comprising at least two solenoids, a shaft, a bell housing, a housing base, first and second solenoid tubes supported onto said housing base, a solenoid frame, and an upper frame; and C) a steering wheel assembly, which mounts onto said shaft.

2. The unidirectional propulsion system set forth in claim 1, wherein said base assembly comprises a main base, first and second motor poles, and a motor top.

3. The unidirectional propulsion system set forth in claim 1, wherein said rotary mechanism and said base assembly are joined by a swivel.

4. The unidirectional propulsion system set forth in claim 1, wherein said first and second solenoid tubes comprise said at least two solenoids respectively, respective first and second lower springs, respective first and second upper springs, and respective bearings.

5. The unidirectional propulsion system set forth in claim 1, wherein said solenoid frame comprises first and second solenoid motors.

6. The unidirectional propulsion system set forth in claim 1, wherein said rotary mechanism further comprises at least two pulleys, at least two solenoid cables, at least two annulus weights, and at least two annulus shafts.

7. The unidirectional propulsion system set forth in claim 6, wherein said solenoid cables extend from said at least two solenoids respectively to respective said annulus weights, running over said respective pulleys.

8. The unidirectional propulsion system set forth in claim 1, wherein said rotary mechanism further comprises at least two weight shaft springs, at least two weight bearings, a pulley frame, and on-switches and off-switches.

9. The unidirectional propulsion system set forth in claim 1, wherein said at least two solenoid tubes having said at least two solenoids respectively extend vertically, defining a predetermined angle with respect to said shaft.

10. The unidirectional propulsion system set forth in claim 1, wherein said steering wheel assembly comprises a steering wheel frame, steering motors with steering motor bearings, a gear wheel, a steering wheel gear, and a top cover.

11. The unidirectional propulsion system set forth in claim 10, wherein said top cover is curved.

12. The unidirectional propulsion system set forth in claim 10, wherein said steering wheel frame having an upper shaft is mounted perpendicular to said shaft.

13. The unidirectional propulsion system set forth in claim 6, wherein said upper frame having said at least two annulus weights and said at least two annulus shafts is perpendicular to said shaft.

14. The unidirectional propulsion system set forth in claim 3, wherein said shaft extends from said swivel to said steering wheel assembly.

15. The unidirectional propulsion system set forth in claim 1, wherein said base assembly and said steering wheel assembly are stationary.

16. The unidirectional propulsion system set forth in claim 6, wherein said rotary mechanism rotates onto said shaft with a predetermined speed generating a centrifugal force, whereby respective said at least two annulus weights move outwardly.

17. The unidirectional propulsion system set forth in claim 16, wherein said generated centrifugal force is converted as an unidirectional driving force.

18. The unidirectional propulsion system set forth in claim 1, wherein said rotary mechanism rotates in both directions.

* * * * *